US007867065B2

(12) United States Patent
Heber et al.

(10) Patent No.: US 7,867,065 B2
(45) Date of Patent: Jan. 11, 2011

(54) HAND-HELD POWER TOOL

(75) Inventors: Andreas Heber, Filderstadt (DE); Arne Timcke, Alfdorf (DE)

(73) Assignee: Robert Bosch GmbH, Stuttgart (DE)

( * ) Notice: Subject to any disclaimer, the term of this patent is extended or adjusted under 35 U.S.C. 154(b) by 211 days.

(21) Appl. No.: 11/571,167

(22) PCT Filed: Jan. 5, 2006

(86) PCT No.: PCT/EP2006/050047

§ 371 (c)(1),
(2), (4) Date: Dec. 22, 2006

(87) PCT Pub. No.: WO2006/092341

PCT Pub. Date: Sep. 8, 2006

(65) Prior Publication Data

US 2008/0070487 A1 Mar. 20, 2008

(30) Foreign Application Priority Data

Mar. 3, 2005 (DE) ..... 10 2005 009 739

(51) Int. Cl.
*B24B 23/04* (2006.01)

(52) U.S. Cl. ..... 451/357; 451/351; 451/356

(58) Field of Classification Search ..... 451/357, 451/356, 351, 344, 358
See application file for complete search history.

(56) References Cited

U.S. PATENT DOCUMENTS

| | | | | |
|---|---|---|---|---|
| 3,336,702 | A * | 8/1967 | Enders | 451/356 |
| 3,849,943 | A * | 11/1974 | Thomas et al. | 451/357 |
| 3,862,520 | A * | 1/1975 | Klebe et al. | 451/357 |
| 3,900,974 | A * | 8/1975 | Klebe et al. | 451/357 |
| 3,918,214 | A * | 11/1975 | Buschman | 451/344 |
| 4,095,375 | A * | 6/1978 | Klebe et al. | 451/357 |
| 4,414,782 | A | 11/1983 | Langenberg | |
| 4,625,462 | A | 12/1986 | Fushiya et al. | |
| 4,686,797 | A | 8/1987 | Hoffman | |
| 4,837,981 | A | 6/1989 | Hashii | |
| 5,206,967 | A * | 5/1993 | Fushiya et al. | 15/97.1 |
| 2005/0164615 | A1 | 7/2005 | Lamprecht | |

FOREIGN PATENT DOCUMENTS

| | | | |
|---|---|---|---|
| DE | 3421020 | A1 * | 12/1985 |
| DE | 102 51 556 | | 5/2004 |
| GB | 814 793 | | 6/1959 |

* cited by examiner

*Primary Examiner*—Dung Van Nguyen
(74) *Attorney, Agent, or Firm*—Michael J. Striker

(57) ABSTRACT

The present invention is based on a hand-held power tool with a housing (12), an oscillating body (18) provided for oscillation relative to the housing (12), and connecting means (22) which fasten the oscillating body (18) to the housing (12).

It is provided that the connecting means (22) include a receiving part (26) which can be installed in the housing (12) and an oscillating element (28) which is separate from the receiving part (26) and is provided for deformation.

15 Claims, 3 Drawing Sheets

HAND-HELD POWER TOOL

BACKGROUND OF THE INVENTION

The present invention is directed to a hand-held power tool.

Publication DE 102 51 556 A1 makes known a hand-held power tool with two housing shells and an oscillating plate which is driven by an eccentric to oscillate laterally relative to the housing shells. The housing shells are connected with the oscillating plate via two elastically deformable connecting elements made of plastic, which are manufactured as a single plastic piece and are installed in the housing shells.

SUMMARY OF THE INVENTION

The present invention is based on a hand-held power tool with a housing, an oscillating body provided to induce oscillation relative to the housing, and a connecting means which fasten the oscillating body to the housing.

It is provided that the connecting means include a receiving part which can be installed in the housing, and an oscillating element which is separate from the receiving part and is provided for deformation. Dividing the connecting means into a receiving part and a separate oscillating element offers the advantage that the receiving part and the oscillating element can easily be made of different materials, and the material of the receiving part and the material of the oscillating element can be adapted, particularly effectively, to the tasks to be performed by the receiving part and the oscillating element. For example, the shaping and fastening receiving part can be made of a solid plastic, and the oscillating element can be made of an elastic plastic or an elastomer with long service life.

In a preferred embodiment of the present invention, the housing includes two housing elements which are interconnected by a fastening means; when the fastening means are released, one of the housing elements can be removed from the oscillating body. Easy access to the components located in the housing, e.g., for making a repair, can be created without having to also separate the removable housing element from the connecting means and the oscillating body connected therewith. Repair work can be simplified as a result, and assembly errors which can occur after the hand-held power tool is repaired can be reduced.

The two housing elements are advantageously located in the direct vicinity of the connecting means. The two housing elements can be connected with the oscillating body in a stable manner via the connecting means. With similar advantage, each of the two housing elements is fastened independently to the oscillating body via the connecting means.

The connecting means can be made particularly easy to install when the connecting means include at least two separate connecting units, each of which includes at least one receiving part and at least one oscillating element.

In a further embodiment of the present invention, the receiving part includes receiving means which are provided to accommodate the oscillating element when the oscillating element is installed. This allows the oscillating element to be installed quickly in the receiving part. The receiving means can be an opening into which the oscillating element can be inserted or screwed.

The receiving means and the oscillating means advantageously form a non-positive connection in the installed state. This offers the advantage that the connecting means can be fastened to the receiving part in a stable manner without the use of tools. This also simplifies assembly, since, after the oscillating element is connected with the receiving part, the oscillating element is retained on or in the receiving part in a non-positive manner, i.e., alone, and it does not accidentally fall out.

A form-fit connection between the receiving means and the oscillating element which prevents the oscillating element from rotating in the receiving means is also advantageous. The oscillating element can be prevented from rotating, thereby also preventing the oscillating element from wearing as a result.

It is also provided that the oscillating element includes at least one polygonal oscillating leg. As a result of this preferred geometry, rotation of the oscillating element in the receiving part and a resultant wearing-away of the oscillating element and, possibly, the receiving part can be reduced.

In a further embodiment of the present invention it is provided that the receiving part is inserted into a pocket-like cavity of the housing. This offers the advantage that the receiving part can be installed in and removed from the housing easily, quickly, without the use of tools, and correctly.

Advantageously, once the oscillating element has been completely installed, a housing element can be pulled out of the receiving part, which has been installed in the other housing element and remains there. This allows disassembly and repair to be carried out easily.

The receiving part can be fastened to the housing in a particularly stable manner when the receiving part and the housing form a tongue-and-groove connection in the installed state.

According to a further embodiment, the housing includes two housing elements, and the receiving part can be inserted into both housing elements, transversely to an eccentric axis in particular. In this manner, the receiving part can be installed in both housing elements particularly easily. For example, the receiving part is first inserted into an assembly shell where other components, e.g., a switch, motor, and armature, are already located. A cover shell is then installed, and the receiving part can be advantageously inserted into a receptacle of the cover shell.

Each housing element advantageously includes a pocket-like cavity into which the receiving part can be inserted separately using an installation device.

A stable, tool-free fastening of the receiving part to the housing can be easily attained when the receiving part and the housing form a non-positive connection in the installed state.

In a further embodiment of the present invention, the oscillating elements can be inserted in the receiving part when it is located in the housing, and after it has been inserted into the housing, in particular. This allows defective oscillating elements to be removed and replaced easily without having to remove the housing elements.

BRIEF DESCRIPTION OF THE DRAWINGS

Further advantages result from the description of the drawing, below. An exemplary embodiment of the present invention is shown in the drawing. The drawing, the description and the claims contain numerous features in combination. One skilled in the art will also advantageously consider the features individually and combine them to form further reasonable combinations.

Detailed Description of the Exemplary Embodiments

Figure 1:
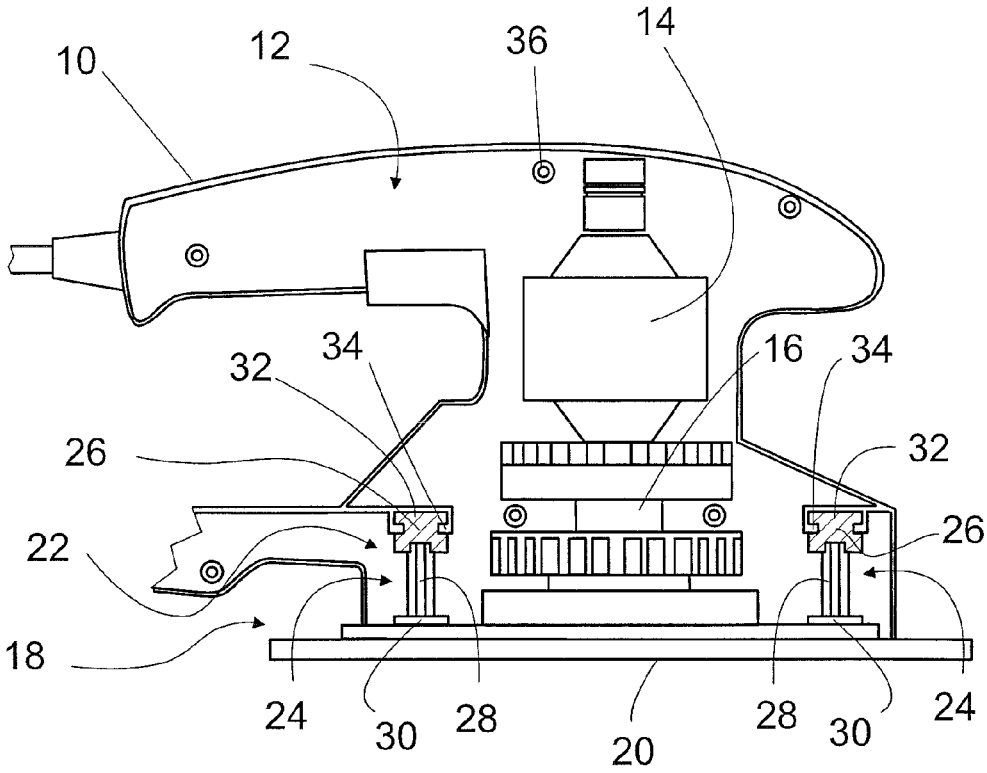
FIG. 1 shows an assembly shell, an oscillating plate, and internal components of an eccentric grinder installed in the assembly shell, with the connecting units which connect the assembly shell with the oscillating plate.
Figure 2:
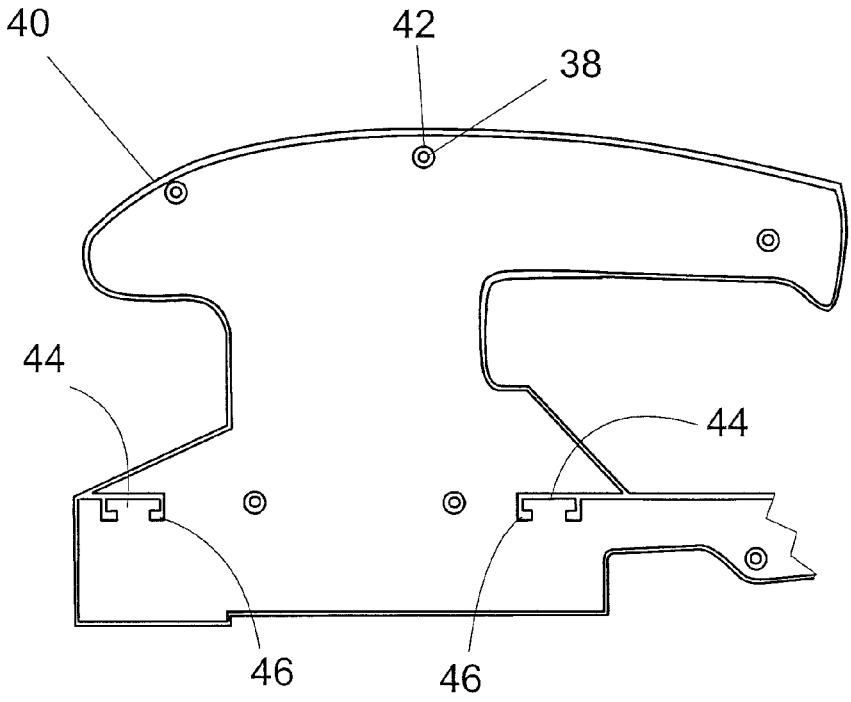
FIG. 2 shows a cover shell of the eccentric grinder, as viewed from the inside.

FIG. 1 shows a schematic depiction of an eccentric grinder with a cover shell in place; the cover shell is shown separately in FIG. 2. The eccentric grinder includes a housing element 10 of a housing 12 designed as an assembly shell, an electric motor 14, and an output shaft 16 which is driven by electric motor 14 and which is installed in housing element 10, and a plate-shaped oscillating body 18 with an oscillating plate 20 which is provided for grinding surfaces. Oscillating body 18 is connected with housing element 10 by connecting means 22 which include two separate connecting units 24. Each connecting unit 24 includes a receiving part 26 and two oscillating elements 28 designed as oscillating legs, each of which has a hexagonal cross section. Oscillating body 18 includes oscillating element receptacles 30 into which oscillating elements 28 are inserted, in the installed state of the eccentric grinder.

Housing element 10 is designed with pocket-like cavities 32, into which receiving parts 26 of connecting units 24 are inserted. Two projections 34, each of which forms a tongue-and-groove connection with receiving part 26, are mounted on the edge of each pocket-like cavity 32. In addition, housing element 10 includes several fastening means receptacles which are provided to receive fastening means 38 shown in FIG. 2.

FIG. 2 shows a housing element 40 designed as a cover shell. It includes several fastening means receptacles 42 which are designed as raised areas or, when viewed from the outside, as recesses, into which fastening means 38 are inserted from the outside. Fastening means receptacles 42 are located in the cover shell such that, when housing 12 is closed, each fastening means receptacle 42 is located opposite to one of the fastening means receptacles 36 of the assembly shell or housing element 10, and fastening means 38, e.g., screws, can be inserted into fastening means receptacles 36. Housing element 40 also includes pocket-like cavities 44 which, in the installed state of the eccentric grinder, are located opposite to pocket-like cavities 32 in housing element 10, and into which receiving parts 26 are inserted, in the installed state of the eccentric grinder. Two projections 46, each of which forms a tongue-and-groove connection with receiving part 26, are formed on the edge of each pocket-like cavity 44.

During operation of the eccentric grinder, oscillating body 18 is driven by a not-shown eccentric which is fastened to output shaft 16. The eccentric makes circular motions which are transferred to oscillating body 18. Oscillating elements 28 prevent oscillating body 18 from rotating relative to housing 12 and fix oscillating body 18 in position on housing 12, to prevent it from tilting relative to housing 12. Oscillating elements 28 are made of a material which is provided in order to deform elastically, e.g., rubber, and to permit oscillating body 18 to perform the swinging motion relative to housing 12 as induced by the eccentric.

When the eccentric grinder is assembled, the internal components, e.g., electric motor 14 and output shaft 16, are first installed in housing element 10. Receiving parts 26 are then inserted into pocket-like cavities 32 of housing element 10. An advantage of dividing connecting means 22 into separate connecting units 24 is that connecting means 22 can then also be easily installed in housing element 10 after output shaft 16 has been installed. Housing element 40 is then placed on housing element 10, so that receiving parts 26 can be inserted into pocket-like cavities 44 of housing element 40. Housing element 40 is then fastened to housing element 10 using fastening means 38, e.g., screws, and housing 12 of eccentric grinder is therefore closed.

Each of the oscillating elements 28 is now inserted into one of the receiving parts 26. Oscillating elements 28 are then inserted into oscillating element receptacles 30 of oscillating body 18 by pressing lightly on oscillating body 18 relative to housing 12. Finally, oscillating body 18 is fastened to the eccentric using a screw. Receiving parts 26 are connected non-positively with both housing elements 10, 40 and with all oscillating elements 28. As a result, these parts can be installed easily, reliably, and correctly.

When maintenance or major repair work is performed on the eccentric grinder, e.g., to repair or replace defective components in the eccentric grinder, housing element 40—which is designed as a cover shell—must be removed in order to access the internal components. To do this, the eccentric grinder does not have to be disassembled in the reverse order of its assembly. Instead, it is only necessary to release fastening means 38 and lift the cover shell away from housing element 10, which is designed as an assembly shell. The cover shell can be lifted off of receiving parts 26, which remain in the assembly shell along with the oscillating elements 28, oscillating body 18, and the fastening to the eccentric.

To replace oscillating elements 28, the fastening of oscillating body 18 on the eccentric is released, and oscillating elements 28 are separated from oscillating element receptacles 30 in oscillating body 18 by pulling lightly on oscillating body 18. Oscillating elements 28 can then be pulled out of receiving parts 26 without having to disassemble housing element 40.

Figure 3:
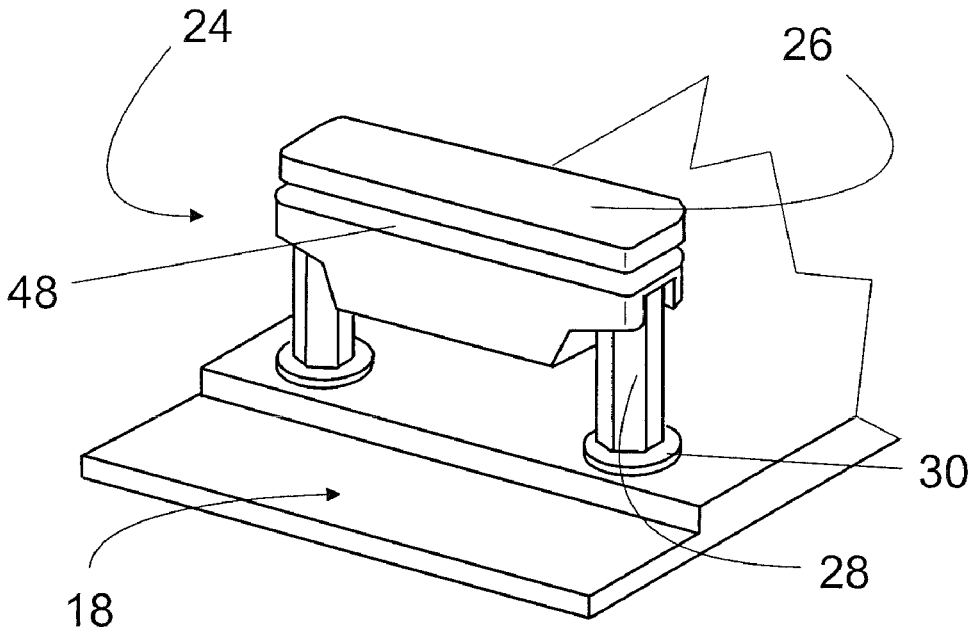
FIG. 3 shows a connecting unit with a receiving part, and oscillating elements inserted in the receiving part and in the oscillating plate.

FIG. 3 shows connecting unit 24 with the two oscillating elements 28 which, in the installed state of the eccentric grinder, are each inserted into one of the oscillating element receptacles 30 of oscillating body 18. When round oscillating elements 28 are used, rotation of oscillating elements 28 during operation of the eccentric grinder in the receiving part 26 and in oscillating element receptacle 30 can cause undesired wear, e.g., on oscillating elements 28. By selecting a polygonal geometry of oscillating elements 28, which are hexagonal in design, it can be attained that this wear is reduced considerably, which increases the service life of oscillating elements 28. Receiving part 26 also has a groove 48, which is located parallel to oscillating plate 20.

Figure 4:
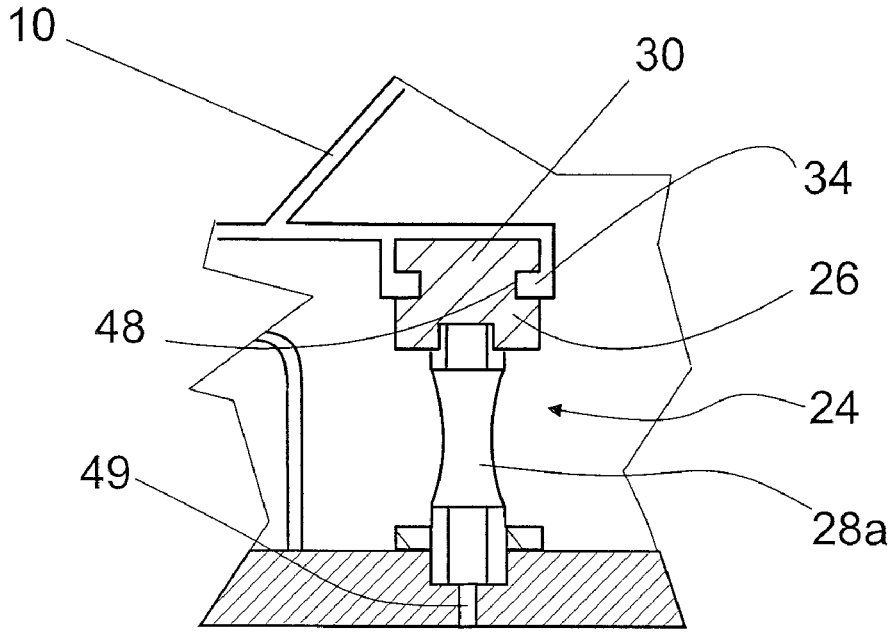
FIG. 4 shows a detailed view of FIG. 1 with the connecting unit inserted in the assembly shell and in the oscillating plate.

In FIG. 4, connecting unit 24 is shown installed in housing element 10. Receiving part 26 is inserted into pocket-like cavity 32 of housing element 10. Via groove 48 of receiving part 26 and projections 34 and 46, receiving part 26 and housing element 10 and 40 are connected by a tongue-and-groove connection, in the installed state of the eccentric grinder. This contributes to a particularly stable fastening and exact positioning of receiving part 26 on both housing elements 10, 40, and enables quick assembly and disassembly. An alternative oscillating element **28*a* is also shown. It is hexagonal in design only in its outer regions, and has a round cross section in a central region. To make it easier to press oscillating element 28*a* into oscillating body 18, a ventilation hole 49** is provided in the oscillating body.

Figure 5:
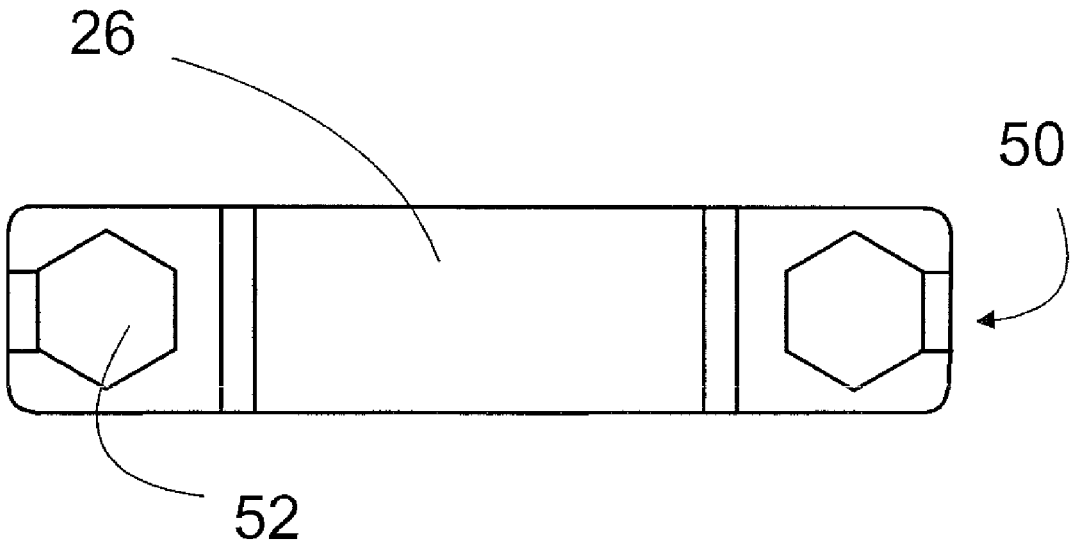
FIG. 5 shows the side of the receiving part which faces the oscillating plate.

FIG. 5 shows the side of receiving part 26 which faces oscillating body 18. Receiving part 26 includes receiving means 50 which include two recesses 52. Recesses 52 are provided to accommodate one oscillating element 28 each, and are therefore designed to match the hexagonal geometry of oscillating elements 28. During assembly, oscillating elements 28 are inserted into recesses 52, which also enables assembly to be carried out in an efficient manner.

What is claimed is:

1. A hand-held power tool, comprising:

a housing (12) comprising a first and a second housing element which are interconnected by a fastening element;

an oscillating body (18) provided for oscillation relative to said housing (12);

a connecting element (22) which fastens said oscillating body (18) to the housing (12) and comprises at least one oscillating element which is provided for deformation;

a receiving part that is distinct from said at least one oscillating element and includes a receiving element provided to accommodate said at least one oscillating element when said at least one oscillating element is installed; and an output shaft (16);

wherein at least said second housing element comprises an inserting element for inserting said receiving part, wherein when said fastening element is released, said second housing element is liftable off of said receiving part and removed from said oscillating body, wherein said first housing element is an assembly shell and said second housing element is a cover shell, and wherein said output shaft (16) is installed in said assembly shell, and wherein said first housing element is connected to said second housing element by said fastening element to form said housing (12) and when said receiving part is inserted into said housing (12), said at least one oscillating element is insertable into said receiving part, and wherein said receiving part comprises two receiving recesses, wherein each of said receiving recesses is provided for inserting an oscillating element.

2. The hand-held power tool as recited in claim 1, wherein the connecting element (22) include at least two separate connecting units (24), each of which includes at least one receiving part (26) and at least one oscillating element (28).

3. The hand-held power tool as recited in claim 1, wherein the receiving part (50) and the at least one oscillating element (28) form a non-positive connection in the installed state.

4. The hand-held power tool as recited in claim 1, wherein the at least one oscillating element (28) includes at least one polygonal oscillating leg.

5. The hand-held power tool as recited in claim 1, wherein the receiving part (26) is inserted into a pocket-like cavity (32, 44) of the housing (12).

6. The hand-held power tool as recited in claim 5, wherein the pocket-like cavity includes a projection at an edge for forming a tongue-and-groove connection with said receiving part.

7. The hand-held power tool as recited in claim 1, wherein said first housing element comprises an inserting element for inserting said receiving part (26).

8. The hand-held power tool as recited in claim 1, wherein the receiving part (26) and the housing (12) form a non-positive connection in the installed state.

9. The hand-held power tool as recited in claim 1, wherein the at least one oscillating element is inserted in the receiving part in a direction that is perpendicular to the oscillating body.

10. The hand-held power tool as recited in claim 1, wherein the at least one oscillating element and the receiving part are made of different materials.

11. A hand-held power tool, comprising:

a housing including a first housing element and a second housing element, wherein said first housing element and said second housing element are interconnected by a fastening element;

an oscillating body provided for oscillation relative to said housing;

a connecting element which fastens said oscillating body to said housing and comprises at least two oscillating elements, wherein said at least two oscillating elements are provided for deformation;

a receiving part made of one piece and forming two receiving recesses for receiving each one of said at least two oscillating elements, wherein each of said receiving recesses faces said oscillating body in an installed state of said receiving part; and an output shaft;

wherein said receiving part comprises a groove which is located parallel to said oscillating body when said receiving part is in an installed state, wherein said first housing element comprises a first cavity, wherein said receiving part is inserted with at least a first portion of said groove into said first cavity, wherein said second housing element comprises a second cavity, wherein said receiving part is inserted with a second portion said groove into said cavity, wherein said first portion of said groove is arranged opposite to said second portion of said groove;

wherein, when said fastening element is released, said second housing element is liftable away from said first housing element, whereby said second housing element is lifted off of said receiving part, wherein said receiving part remains connected with said first housing element along with said at least two oscillating elements and said oscillating body, wherein said first housing element is an assembly shell and said second housing element is a cover shell, wherein said output shaft is installed in said assembly shell, and wherein, when said receiving part is inserted into said housing, said at least two oscillating elements are insertable into said receiving part when said oscillating body is disassembled without having to disassemble said second housing element.

12. The hand-held power tool as recited in claim 11, further comprising a motor installed in the first housing element, wherein said first housing element is formed as an assembly shell, wherein the second housing element is formed as a cover shell that covers the first housing element, and wherein, when the cover shell is lifted off of the assembly shell, the motor remains in the assembly shell.

13. The hand-held power tool as recited in claim 11, wherein projections are formed on an edge of each cavity and form a tongue-and-groove connection with said receiving part.

14. The hand-held power tool as recited in claim 13, wherein the receiving part has a groove, via which the receiving part and the housing elements are connected by a tongue-and-groove connection.

15. The hand-held power tool as recited in claim 11, wherein the at least two oscillating elements and the receiving part are made of different materials.

* * * * *